United States Patent [19]

Hunt et al.

[11] 4,164,397

[45] Aug. 14, 1979

[54] FUEL GAS PRODUCTION

[76] Inventors: Herbert H. Hunt, 3608 Vine Maple, Eugene, Oreg. 97405; Harold S. Worcester, 91040 Hill Rd., Springfield, Oreg. 97417

[21] Appl. No.: 878,422

[22] Filed: Feb. 16, 1978

Related U.S. Application Data

[63] Continuation-in-part of Ser. No. 733,429, Oct. 18, 1976, abandoned.

[51] Int. Cl.[2] ..... C10J 3/16

[52] U.S. Cl. ..... 48/209; 44/1 E; 48/111; 48/DIG. 1; 201/34; 201/38

[58] Field of Search ..... 48/209, 210, 197 R, 48/111, 73, DIG. 1; 201/15, 20, 33, 34, 37, 38; 44/1 E, 1 R, 10 B, 10 E

[56] References Cited

U.S. PATENT DOCUMENTS

| | | | |
|---|---|---|---|
| 795,874 | 8/1905 | Whitfield | 48/73 |
| 1,917,196 | 7/1933 | Perry | 201/34 |
| 2,757,129 | 7/1956 | Reeves et al. | 201/34 |
| 3,977,947 | 8/1976 | Pyle | 48/111 |
| 4,052,173 | 10/1977 | Schulz | 48/209 |

*Primary Examiner*—S. Leon Bashore
*Assistant Examiner*—George C. Yeung
*Attorney, Agent, or Firm*—Kolisch, Hartwell, Dickinson & Stuart

[57] ABSTRACT

A method of manufacturing fuel gas from lignocellulose material such as wood. Wood is converted to fuel gas in a descending bed reactor which encloses a descending bed of wood material. Gas produced in the reactor travels upwardly through and thence out from the top of the descending bed, with a portion of the gas being recirculated and introduced as reflow gas, together with air, to a combustion zone established at the base of the descending bed.

3 Claims, 2 Drawing Figures

FUEL GAS PRODUCTION

This application is a continuation-in-part of prior filed application Ser. No. 733,429, filed Oct. 18, 1976, now abandoned.

This invention relates to gas manufacture, and more particularly to a method of making a fuel gas from lignocellulosic material.

Utilizing the invention, a relatively clean burning fuel gas is obtained, which typically burns with a blue flame. The gas is produced efficiently, with minimal loss of energy by way, for example, of expending such in the sensible heat of the gas produced. Thus, typically the temperature of the output gas manufactured according to the invention will be in the neighborhood of 180°-210° F. Following the method of the invention, the volume of gas produced is readily controlled, with simple adjustments being effective substantially to cut off gas production when such is desired, as during a period of low demand, and to reestablish full volume production, or any desired fraction thereof, when the need therefor is established. Flexibility in operation is also reflected in the fact that size, moisture content, and makeup of the lignocellulosic material employed in manufacturing the gas is subject to wide variation, with excellent results still obtained.

A general object of the invention, therefore, is to provide an improved method of manufacturing gas from lignocellulosic material which is relatively simply performed, but which nevertheless produces gas with relatively high efficiency.

Another object is to provide such a method which is highly flexible in operation. This is reflected in the amount of control which is provided in the gas output obtainable in a given facility. Flexibility is also reflected in the variability permitted in the type of material utilized to make the gas.

A further object is to provide a method of manufacturing fuel gas which is performable to produce a clean burning gas, which burns without the production of carbon deposits or smoke.

Another object is to provide a fuel gas producing method which is reliable, and performable with relatively little supervision.

Figure 1:
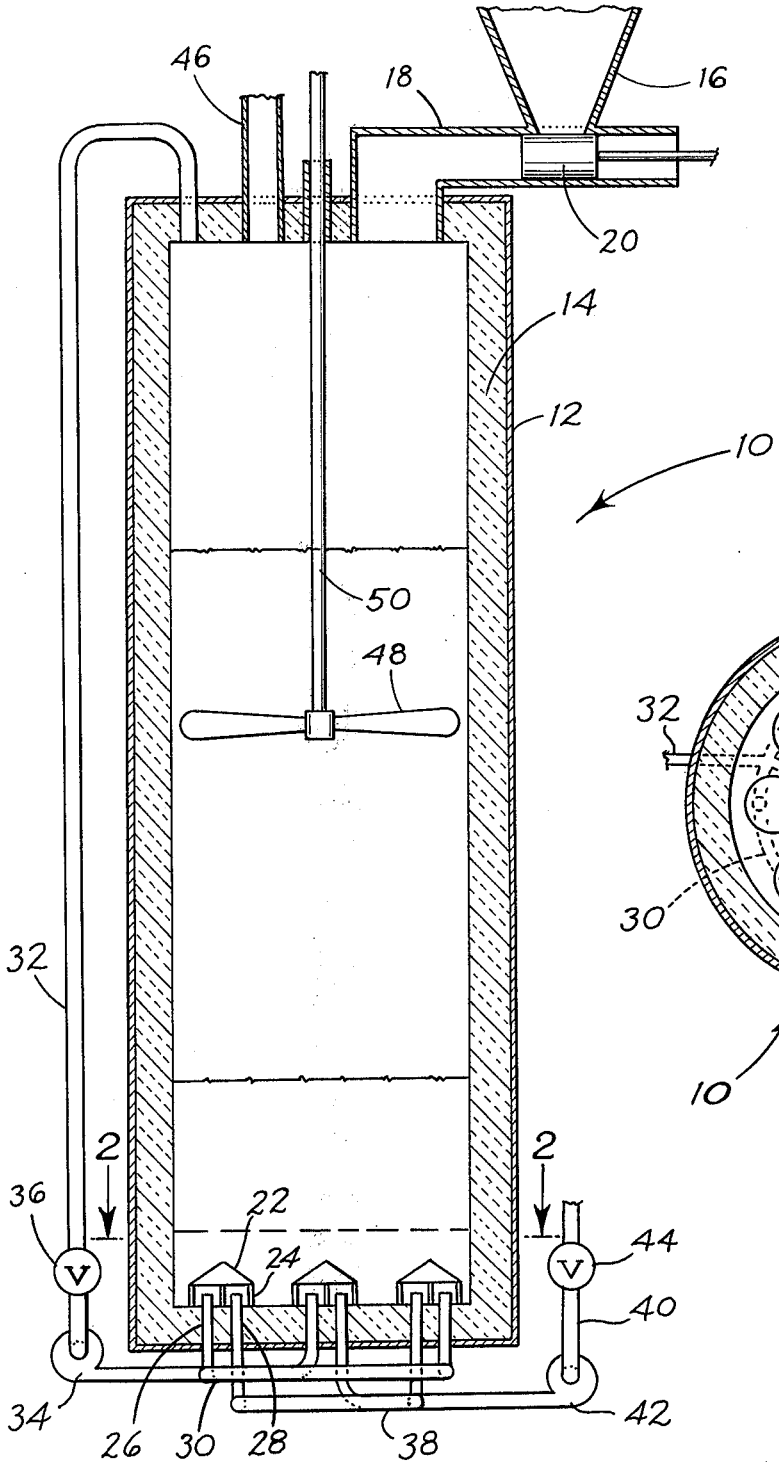
Figure 2:
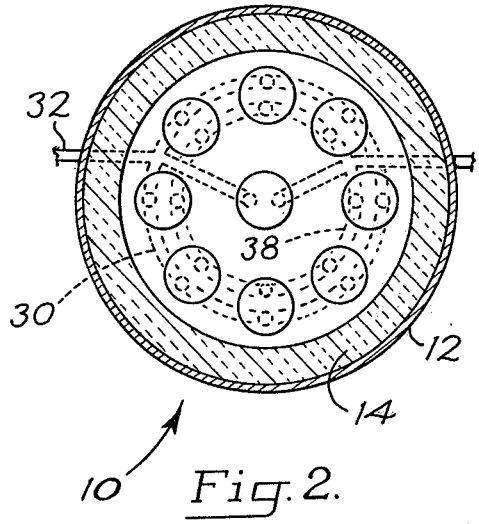

These and other objects and advantages are attained by the invention, which is described hereinbelow in conjunction with the accompanying drawings, wherein:

FIG. 1 is a cross-sectional view illustrating a descending bed reactor such as may be utilized in performing the method of the invention; and FIG. 2 is a cross-sectional view of the reactor shown in FIG. 1, taken generally along the line 2—2 in FIG. 1.

In general terms, fuel gas is produced according to the invention with the introduction of the lignocellulosic material which is to be converted into the gas into the top of a descending bed reactor. Under operating conditions, within the reactor, and at the base of a descending bed produced therein, a combustion zone is established, with char located in this combustion zone reacting with oxygen and water vapor introduced into the combustion zone to produce carbon monoxide and hydrogen. The char present in this combustion zone is the conversion product of the solid hydrocarbons in the lignocellulosic material, produced with descent of the lignocellulosic material to the base of the descending bed.

Above the combustion zone and bed of char described, a so-called exothermic distillation zone is established, which is at a somewhat lower temperature than the temperature of the char bed. Decomposition of the lignocellulosic material in the distillation zone occurs, with conversion of the solid hydrocarbons in the material to hydrocarbons which are in the form of fixed and condensible gas. The conversion is the result of what may be described as a cracking of the hydrocarbons.

Above this exothermic distillation zone a so-called drying zone is established, which extends upwardly to the top of the descending bed of material. The gas produced in the combustion and distillation zones earlier described, possessing the heat liberated in these zones, on moving upwardly through the drying zone is effective to dry the material in the upper portion of the bed. The moisture driven out of the material moves upwardly as water vapor. The sensible heat of the gas moving upwardly through the descending bed is transferred to the lignocellulosic material descending downwardly, and gas emanating from the top of the bed (which is the output gas produced by the reactor) has a temperature normally somewhat below the boiling point of water (under the pressure condition existing in the reactor which ordinarily is substantially atmospheric).

It was earlier stated that among the reactions occuring in the combustion zone was the reaction of char with water vapor to produce carbon monoxide and hydrogen. Introduction of this water vapor into the combustion zone is accomplished by separating from the output gas emanating from the top of the descending bed a fraction of such gas, and directing such fraction, referred to as reflow gas, back into the reactor at the combustion zone. This gas, which is nearly saturated with water at the temperature existing at the top of the descending bed, supplies the steam required in the producer reaction taking place in the combustion zone which results in the formation of hydrogen. By using such reflow, it is unnecessary to supply the steam required in the producer gas reaction from some external supply, and the fuel cost and equipment cost that would be reflected in an external supply are eliminated.

The reflow gas which is introduced to the reactor contains, in addition to water vapor, hydrocarbons in the form of both fixed and condensable gas. The higher hydrocarbons, on being reintroduced to the reactor and moving upwardly through the bed, are subjected to further cracking thereby tending to produce in the output gas a lower proportion of so-called condensable hydrocarbons.

Oxygen is supplied into the combustion zone by feeding air thereinto. The oxygen and the reflow gas are introduced at substantially common locations in the combustion zone, to produce what is referred to as a common presence of such gasses at these locations.

A proper heat balance is maintained in the combustion zone, with the temperature maintained at a high enough level to produce efficient production of so-called producer gas by conversion of carbon and steam to carbon monoxide and hydrogen, but below the level at which the ash of the lignocellulosic material fuses whereby clinker formation is prevented. The temperature at the top of the bed should not exceed the boiling point of water under the pressure conditions existing, this temperature being controlled by controlling the heat of the combustion zone and the height of material existing in the descending bed as a whole.

The air and the reflow gas, while introduced to the combustion zone at one or more common locations in said zone, preferably are not premixed prior to entering the combustion zone. This is because when the gasses are mixed, an explosive mixture tends to be produced.

The temperature maintained in the combustion zone is controlled by controlling the amount of gas which is used as reflow gas. With an increase in reflow gas, the temperature in the combustion zone tends to drop, by reason of the increased amount of water vapor introduced by increasing the reflow. Conversely, dropping the reflow gas results in a higher temperature in the combustion zone. The amount of air introduced into the combustion zone also affects the temperature, with an increase in the air introduced resulting in a higher temperature in the combustion zone. The amount of air supplied the combustion zone is controlled so that with reflow gas adjusted to obtain proper temperature in the combustion zone, the gas velocity upwardly through the descending bed that results is somewhat below that which would produce turbulence in the lignocellulosic material of the bed.

Apparatus such as may be used in manufacturing fuel gas as contemplated is illustrated in the drawings. Referring to the drawings, a reactor is shown generally at 10 comprising an encompassing outer metal shell 12 lined about the inside with an insulative refractory lining 14.

Material to be fed into the descending bed reactor is collected in a hopper shown at 16. The base of the hopper opens to a tube 18 communicating with the interior of the reactor adjacent the top thereof. A piston 20 which closes off the base of the hopper when in the position shown is retracted or moved to the right in FIG. 1 to permit material to fall from the hopper into the tube. Subsequent advancement of the piston is effective to push such material forwardly, with material carried forwardly of the piston in the tube ultimately cascading downwardly into the reactor.

Inside the reactor and adjacent its base plural conically shaped canopies or hoods 22 are provided. These are distributed about the cross-sectional area of the inside of the reactor. The canopies occupy a common level inside a reactor, and each is supported a slight distance above lining 14 at the base of the reactor by legs 24. A canopy produces cavitation in the material forming the descending bed where such material falls downwardly about the sides of the canopy.

Communicating with the space located under each canopy is a reflow gas conduit 26 and an air supply conduit 28. With the upper, open discharge ends of these conduits being closely adjacent where they admit gas to the interior of the reactor on the under side of a canopy, the conduits are effective to produce a common presence of admitted gasses at each location of introduction, which is under each of the various canopies shown.

The various reflow gas conduits are joined by a manifold system 30 to a reflow gas line 32 having an upper end communicating with the interior of the reactor adjacent the top of the reactor. The reflow gas line includes a blower 34 producing gas movement and a damper valve 36.

The various air supply conduits 28 are connected by a manifold system 38 to an air supply line 40 provided with a blower 42 and a damper valve 44.

Also connecting with the top of the descending bed reactor is an output gas line 46.

In order to enable mixing of the material being processed, to inhibit bridging and obtain evenly distributed gas flow in that part of the descending bed which is the drying zone thereof, an agitator may be provided, as exemplified by agitator arm 48 mounted on the bottom end of a power rotated shaft 50.

Describing a specific example of manufacturing fuel gas as contemplated by the invention, so-called hog fuel was employed as the lignocellulosic material, which is a mixture of bark, wood chips, slivers and sawdust ranging in size from four inch pieces down to the size of sawdust fines. Hog fuel of this description is a by-product of the forest products industry. The moisture content of the material, based on the oven dry weight of the material, was estimated to be 50%.

Some fuel was ignited at the base of a reactor for start-up purposes. The reactor employed had a diameter of four feet and a height of approximately twelve feet. After start-up, additional fuel was introduced to the reactor. After a period of approximately 15 minutes, a stabilized operating condition was obtained.

Under operating conditions, the descending bed in the reactor was approximately eight feet deep. At the base of the reactor, and for a depth of approximately one foot extending upwardly from the level of introduction of the reflow gas and air, was a bed of char having a temperature at its hottest point of approximately 1700° F. Above this char bed (which is the combustion zone in the reactor), the material in the descending bed extended in a zone of about two feet depth with the temperature of such material ranging from approximately 500° F. at the top of such zone to about 1100° F. adjacent the base of the zone. The material in this zone was essentially moisture free and undergoing exothermic distillation. Above this distillation zone was a drying zone of approximately five foot depth, the temperature at the top of the bed being approximately 190° F.

Approximately 7% of the gas produced emanating from the top of the bed was channeled through reflow gas line 32 to be introduced to the base of the reactor into the combustion zone. Specifically, gas was recirculated through the reflow line at approximately the rate of 3,000 cubic feet per hour. Fuel gas was withdrawn from outlet 46 at approximately the rate of 40,000 cubic feet per hour.

Hog fuel was fed into the reactor to maintain the level of the descending bed at the rate of about one-quarter metric ton per hour.

Air was introduced into the combustion zone (together with the reflow gas) at the rate of approximately 14,000 cubic feet per hour.

Pressure in the reactor, at the top of the reactor, was one inch of water above atmospheric.

The gas produced had a significant amount of hydrogen. The gas burned with a blue flame without the production of carbon deposits.

While great liberality is permitted by the invention in connection with the type of fuel used to produce the gas, ordinarily fuel having a moisture content ranging from about 20% to 80% is used, with preferably its moisture content ranging from 40% to 70%. With a lower moisture content, production of hydrogen in the reactor by a producer gas reaction is effected, and a higher moisture content tends to lower the efficiency of the manufacture.

Utilizing hog fuel for the manufacture of the gas, the temperature in the combustion zone preferably is maintained within the range of about 1300° F. to 2100° F.

and optimumly between 1400° F. and 1700° F. by control of the amount of gas recirculated as reflow gas. When converting wood to gas, should the temperature in the combustion zone rise appreciably above 2100° F., clinkers tend to form within the reactor. This is because the wood ash, instead of being carried off by the gas produced, fuses under the high temperature condition existing. With the use of a different lignocellulosic material, such as straw, with ash having a lower melting point than hog fuel, a lower temperature is employed in the combustion zone to inhibit clinker formation.

In the usual instance, the amount of gas circulated in the reflow line with the obtaining of proper temperature control ranges from about 5% to 30% of the gas discharged from the top of the descending bed. The amount of air which is introduced ordinarily ranges from about 10% to 40% of the gas discharged.

If it is desired temporarily to stop the production of gas, this is readily accomplished by stopping the circulation of reflow gas, and stopping the introduction of air into the combustion zone of the reactor. In the example set forth above, gas production was stopped for a period of several days in this manner with gas production then reinstated by reintroducing air and reflow gas to the base of the reactor. Production at any desired fraction of maximum output is likewise readily obtained, through proper control of the amount of gas circulated as reflow and the amount of air introduced to the reactor.

While various zones have been described in connection with the descending bed, such as the combustion zone, the distillation zone and the drying zone, it should be obvious that there are no exact lines of demarcation between these various zones, and the height of a particular zone is dependent upon the type of material processed, its moisture content, the gas production rate, etc. A unique feature of the instant invention is that it does not require that an exact temperature level be maintained at an exact height within the reactor proper. The gas that is recirculated is the gas which is discharged from the top of the descending bed whatever the level of that bed.

It should be obvious that the method of the invention has a number of advantages over processes known to date. The apparatus required for the gas manufacture is relatively simple and maintenance free. The method is relatively flexible in that bark, wood, straw or other forms of lignocellulosic material may be utilized, and the moisture content of these materials is not critical. Shutdown and reduced production are readily obtained by proper control of the amount reflow of gas recirculated as reflow gas and the amount of air introduced to the reactor. Gas production is efficient, with the output gas produced having a relatively low sensible heat. With ash produced in the combustion zone being carried out with the gas produced, the need to clean solid residue such as clinkers is eliminated. The reactor may be operated at pressures below, at, or above atmospheric pressure.

Summarizing some of the features of the invention as such has been described, all of the gas produced in the bed including the gas produced in the combustion zone, the gaseous hydrocarbons produced in the distillation zone, and the water vapor produced in the drying zone, is channeled upwardly through the material in its bed with transfer of sensible heat from such gas to such material. Ash produced is carried out of its reactor with such gas. The gas which is produced which emanates from the top of the bed is at or below the boiling point of water, and with a relatively low sensible heat, which contributes to minimum energy loss. There is no necessity for establishing any exact levels for the drying zone, distillation zone, or combustion zone, with the gas which is utilizied all coming from the top of the bed. The reflow gas containing water vapor and the gaseous hydrocarbons is mixed with air before such gas contacts the material in the bed. The gas mixture resulting produces an even heat in the combustion zone, with a heat balance established whereby the exothermic reaction of char with air supplies the heat necessary for the endothermic reaction of char with water vapor to produce a water gas. The exothermic combustion reaction also provides the heat necessary to produce further cracking of the hydrocarbons. With the mixture of reflow gas and air tending to be explosive, mixing is performed immediately prior to this mixture of gas contacting the material in the reactor, substantially at the time the gas mixture is introduced into the reactor. The only gas flows which need to be controlled in controlling the temperature within the reactor are the reflow gas flow and the air flow. The production of an even heat in the combustion zone, as a result of mixing of the reflow gas and air as described, insures against clinker formation. The ash produced is removed from the reactor by entrainment in the upwardly flowing gas produced in the combustion zone.

It is claimed and desired to secure by Letters Patent:

1. A process for making conbustible gas from lignocellulose material which comprises establishing a descending bed of such material in a descending bed reactor, newly introduced material being dropped onto the top of such bed and such newly introduced material having a moisture content within the range of 20% to 80% by weight, said descending bed having adjacent the top thereof a drying zone wherein the material is dried with the production of water vapor, and progressing downwardly from the drying zone a distillation zone where the material is converted to gaseous hydrocarbons and char, and below the distillation zone a combustion zone where the char is reacted with the production of additional gas and residual ash, channeling the ash and all of the gas as such is produced in said bed upwardly through and thence out the top of the bed with the sensible heat of such gas being transferred directly to the material in the bed, dividing gas flowing upwardly from the top of said bed into one fraction which is the gas manufactured and another fraction which is reflow gas, said reflow gas comprising the water vapor, gaseous hydrocarbons, and said additional gas produced in the combustion zone, forming a cavity within said bed in the combustion zone thereof, and contacting the material in said bed in said combustion zone with the reflow gas together with air for the support of combustion, the air and reflow gas before contacting such material initially being mixed in said cavity to produce a mixture comprising air, water vapor and gaseous hydrocarbons, the combustion zone being maintained at a temperature above about 1300° F. and below the fusion temperature of the ash of said material, said additional gas produced in said combustion zone comprising the gas combustion product produced by the exothermic reaction of char with oxygen supplied by the air and water gas produced by the endothermic reaction of char with water vapor in a water-gas reaction, the top of said bed being maintained at a temperature no higher than the boiling point of water at the pressure condition existing in the reactor.

2. A process for making combustible gas from lignocellulose material which comprises establishing a descending bed of such material in a descending bed reactor, newly introduced material being dropped into the top of said bed, and such newly introduced material having a moisture content within the range of 20% to 80% by weight, said descending bed having adjacent the top of the bed a drying zone where the material is dried with the production of water vapor, and progressing downwardly from the drying zone a distillation zone where the material is converted to gaseous hydrocarbons and char, and below the distillation zone a combustion zone where the char is reacted with the production of additional gas and residual ash, channeling the ash and all of the gas as such is produced in said bed upwardly through and thence out the top of the bed with the sensible heat of such gas being transferred directly to the material in the bed, dividing gas flowing upwardly from the top of said bed into one fraction which is the gas manufactured and another fraction which is reflow gas, said reflow gas comprising the water vapor, gaseous hydrocarbons, and said additional gas produced in the combustion zone, and introducing air and reflow gas into said reactor at said combsution zone with initial combining of the air with the water vapor, gasous hydrocarbons and said additional gas in said reflow gas substantially at the time of entering the reactor and before such gas mixture contacts the material in the bed, the combustion zone being maintained at a temperature above about 1300° F. and below the fusion temeprature of the ash of said material, and the top of said bed being maintained at a temperature no higher than about the boiling point of water at the pressure condition of the reactor, said additional gas produced in said combustion zone comprising the gas combustion product produced by the exothermic reaction of char with oxygen suppled by its air and water gas produced by the endothermic reaction of char with water vapor in a water-gas reaction.

3. The process of claim 2 which comprises forming a cavity within said bed in the combustion zone thereof and the initial mixing of the air with the reflow gas including its water vapor, gaseous hydrocarbons, and said additional gas is performed in said cavity before the gas contacts material in said bed.

* * * * *

UNITED STATES PATENT AND TRADEMARK OFFICE

CERTIFICATE OF CORRECTION

PATENT NO. : 4,164,397

DATED : August 14, 1979

INVENTOR(S) : Hunt et al.

It is certified that error appears in the above-identified patent and that said Letters Patent are hereby corrected as shown below:

In column 6, line 30, delete "conbustible" and insert --combustible--.

In column 8, line 5, delete "combsution" and insert --combustion--.

In column 8, line 6, delete "gasous" and insert --gaseous--.

In column 8, line 11, delete "temeprature" and insert --temperature--.

Signed and Sealed this

*Eighteenth* Day of *March 1980*

[SEAL]

*Attest:*

SIDNEY A. DIAMOND

*Attesting Officer*

*Commissioner of Patents and Trademarks*